US006267334B1

(12) United States Patent
Siu

(10) Patent No.: US 6,267,334 B1
(45) Date of Patent: Jul. 31, 2001

(54) ADJUSTABLE BAG HOLDER

(76) Inventor: Victor Wai Park Siu, 5304 Christopher Court, Burnaby, British Columbia (CA), V5H 2K2

( * ) Notice: Subject to any disclaimer, the term of this patent is extended or adjusted under 35 U.S.C. 154(b) by 0 days.

(21) Appl. No.: 09/148,851

(22) Filed: Sep. 4, 1998

Related U.S. Application Data

(63) Continuation-in-part of application No. 29/080,946, filed on Dec. 22, 1997, now Pat. No. Des. 398,121, and a continuation-in-part of application No. 29/091,116, filed on Jul. 23, 1998.

(51) Int. Cl.[7] ..... A63B 55/04
(52) U.S. Cl. ..... 248/97; 248/95
(58) Field of Search ..... 248/97, 95, 99, 248/101, 346.06, 346.07, 149, 146, 153, 175, 176.3, 127, 310, 312.1

(56) References Cited

U.S. PATENT DOCUMENTS

| | | | | |
|---|---|---|---|---|
| 261,458 | * | 7/1882 | Holekamp | 248/97 |
| 292,648 | * | 1/1884 | Hayman | 248/97 |
| 1,457,246 | * | 5/1923 | Hause | 248/97 |
| 1,490,863 | * | 4/1924 | Stevenson | 248/97 |
| 2,959,387 | * | 11/1960 | Ficek | 248/149 |
| 3,140,070 | * | 7/1964 | Doebele | 248/97 |
| 3,744,081 | * | 7/1973 | Miller | 15/257.1 |
| 4,467,989 | * | 8/1984 | Stroh | 248/97 |
| 5,213,145 | * | 5/1993 | Huang et al. | 141/391 |
| 5,263,672 | * | 11/1993 | He | 248/97 |
| 5,427,340 | * | 6/1995 | Stromsmoe et al. | 248/97 |

* cited by examiner

*Primary Examiner*—Anita M. King
(74) *Attorney, Agent, or Firm*—Oyen Wiggs Green & Mutala

(57) ABSTRACT

Existing free-standing bag holders are of fixed width exist, both with and without wheels, for supporting plastic garbage bags, recycling bags etc. However, bag holders of fixed width are not useful for all bags. The present invention provides a bag holder which is adjustable to support large, flexible bags of various widths by adjusting the spacing of vertical support members on a base member.

9 Claims, 17 Drawing Sheets

ADJUSTABLE BAG HOLDER

CROSS-REFERENCE TO RELATED APPLICATIONS

This application is a continuation-in-part of design patent application Ser. No. 29/080,946, filed Dec. 22, 1997 entitled BAG HOLDER, which issued on Sep. 8, 1998 as Pat. No. D398121, and also is a continuation-in-part of design patent application no. Ser. No. 29/091,116, filed Jul. 23, 1998 entitled BAG HOLDER, which is pending.

TECHNICAL FIELD

The invention relates to frames for free-standing support of garbage bags, recycling bags, laundry hampers and the like, and more particularly to adjustable frames for supporting bags of variable width.

BACKGROUND ART

Various metal or plastic frames exist for supporting in a free-standing way open-ended bags, such as disposable garbage bags, garden bags, recycling bags and laundry hampers. To date, free-standing bag holders of fixed width exist, both with and without wheels, for supporting plastic garbage bags, recycling bags etc. It is important that such articles be inexpensive to manufacture, given the nature of the article. However, flexible bags for such uses come in various widths, so a bag holder of fixed width is not useful for all bags.

There is therefore a need for a bag holder which is adjustable to support bags of various widths.

DISCLOSURE OF INVENTION

The present invention therefore provides an adjustable support for flexible bags having an open end, comprising:

i) first and second opposed, parallel vertical elements, each vertical element comprising means at the upper end thereof for receiving the open end of the bag;

ii) a base member adapted for stable placement on a planar surface connected to the vertical elements, the vertical elements being slidably engaged with the base member, whereby the space between the vertical elements is adjustable; and iii) means for releasably securing the vertical elements at a fixed spacing.

BRIEF DESCRIPTION OF DRAWINGS

In drawings which illustrate a preferred embodiment of the invention.

BEST MODE(S) FOR CARRYING OUT THE INVENTION

Figure 1:
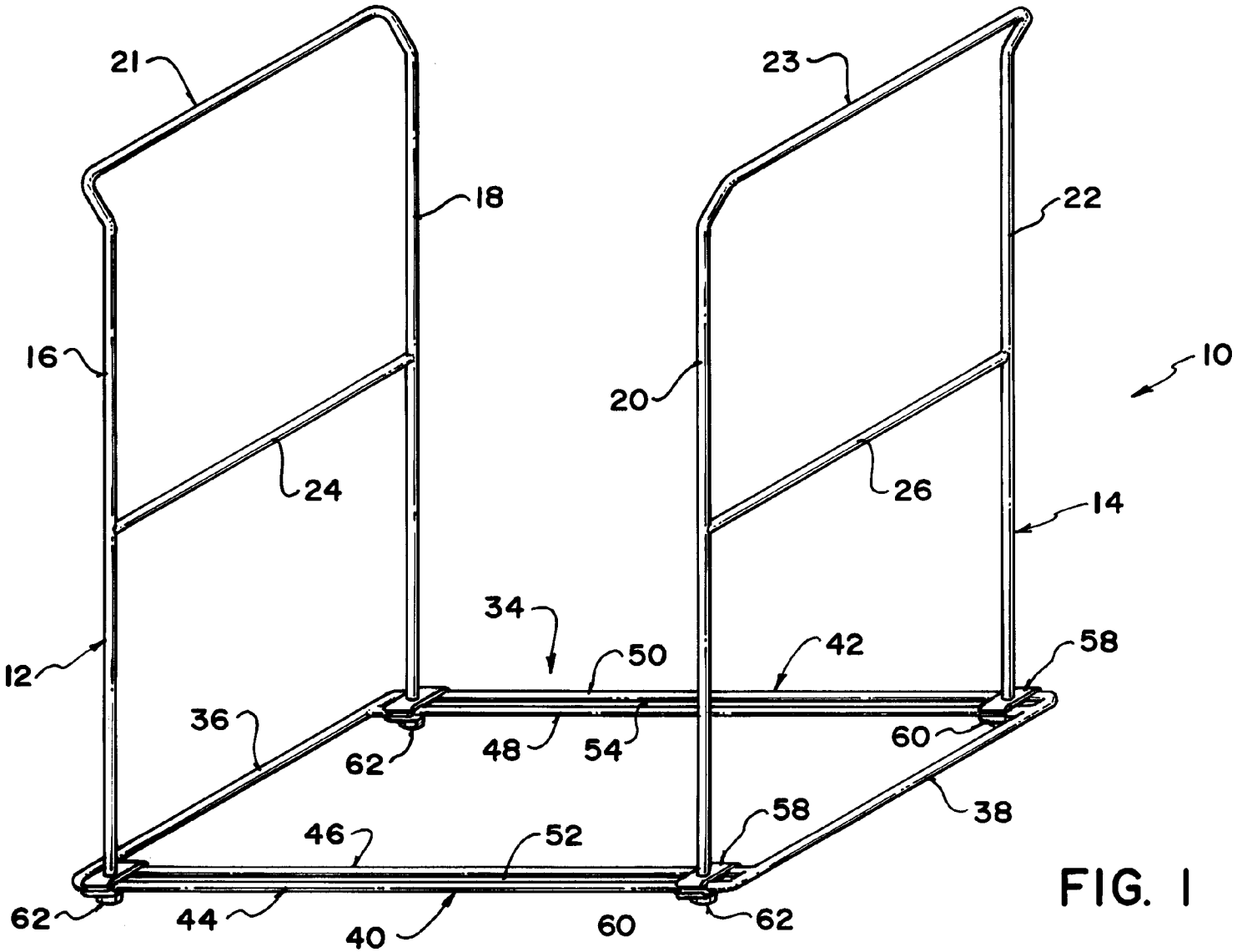
FIG. 1 is a perspective view of a first embodiment of the invention, in which the lateral positions of the two vertical frames are adjustable to a continuum of positions along the base element.
Figure 2:
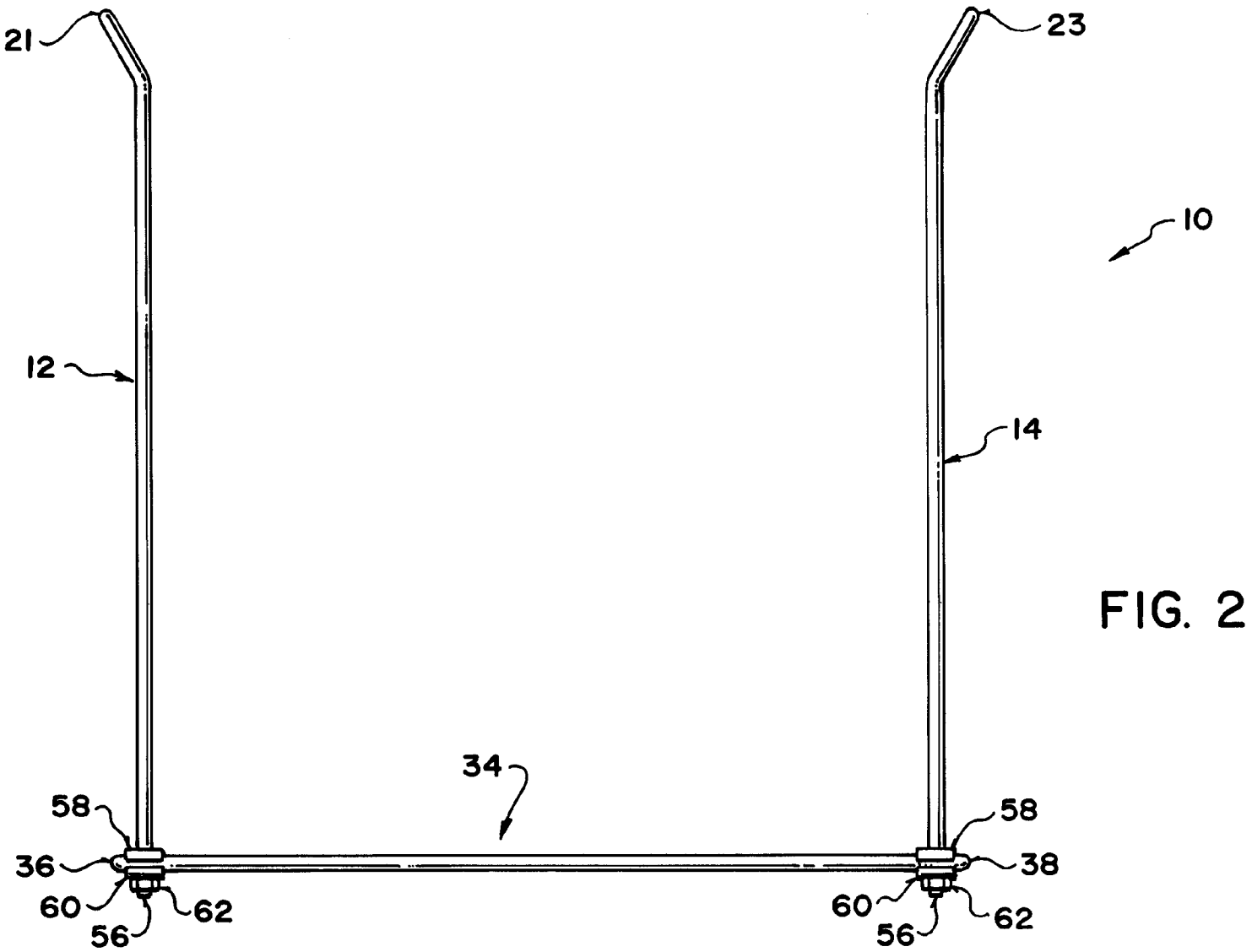
FIG. 2 is a front view of the embodiment of the invention shown in FIG. 1, the rear view being a mirror image thereof.
Figure 3:
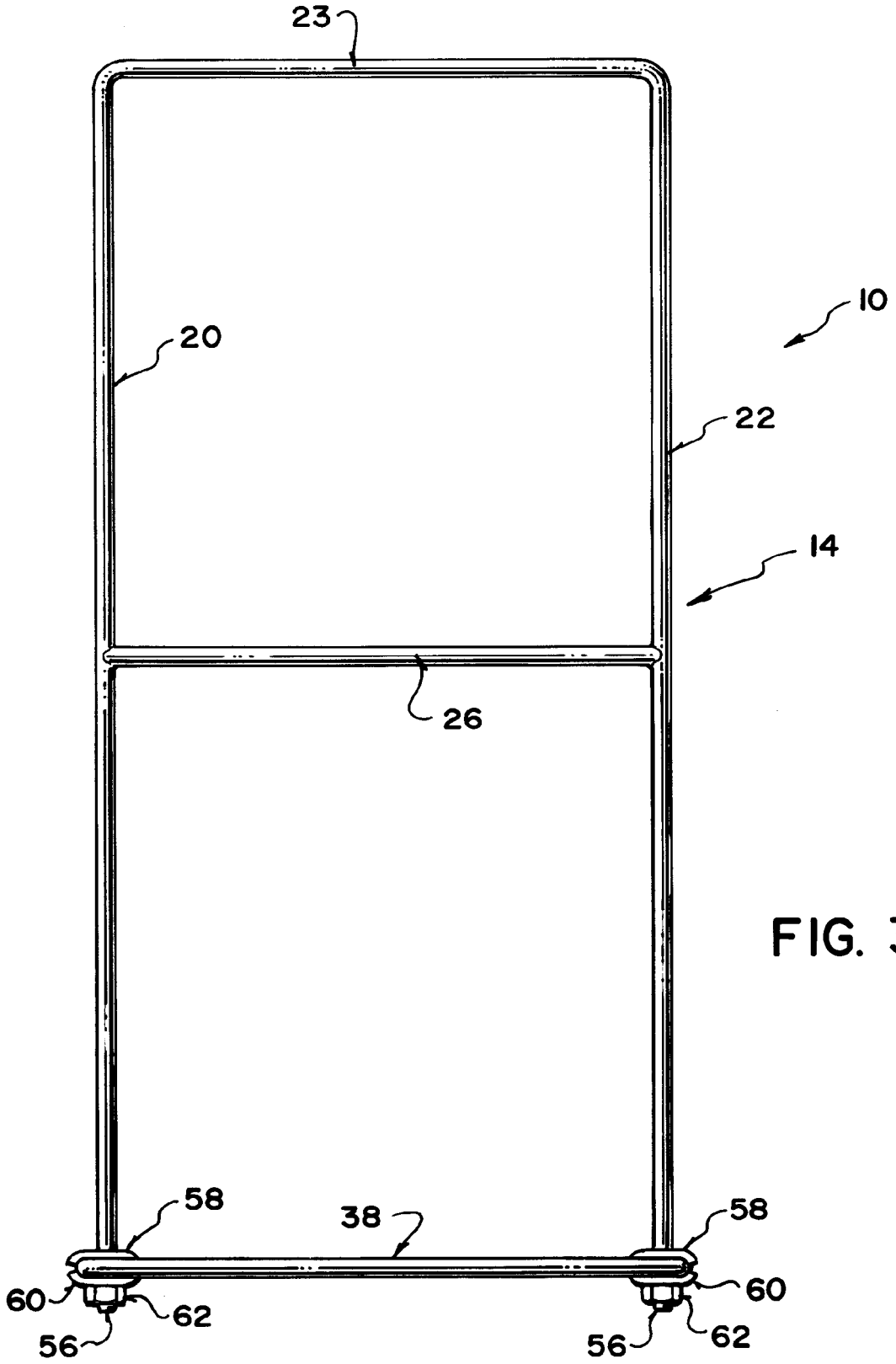
FIG. 3 is a right side view of the invention shown in FIG. 1, the left side view being a mirror image thereof.
Figure 4:
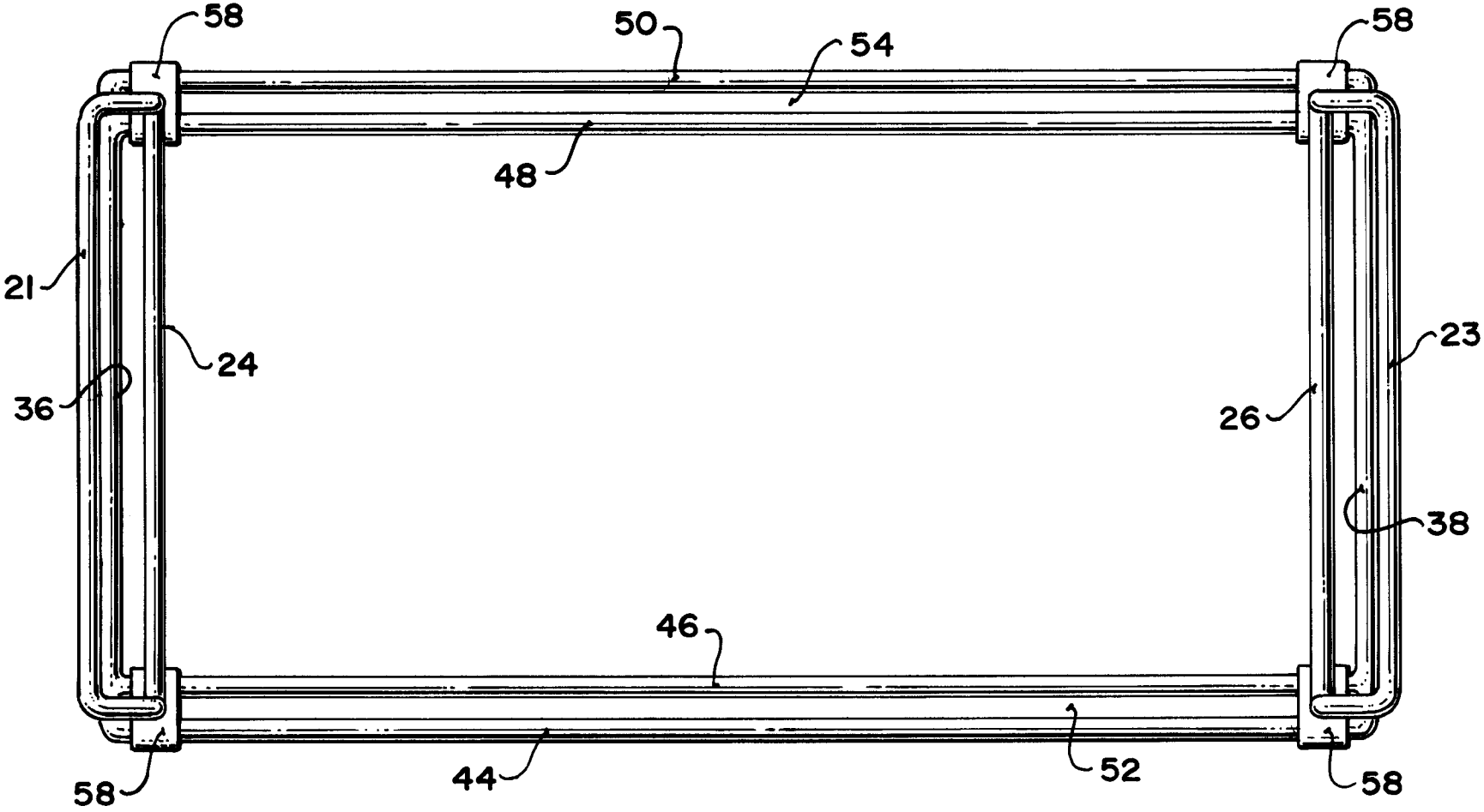
FIG. 4 is a top view of the invention shown in FIG. 1.

With reference to FIGS. 1–5, a first embodiment of a bag holder 10 according to the invention is shown. It is preferably constructed of steel tubing, which may be chrome plated for a more polished appearance. Left and right vertical elements 12, 14. Each vertical element 12, 14 consists of parallel vertical members 16, 18, 20, 22, which are angled outward at the upper end thereof and joined by horizontal members 21, 23 to allow the open end of a flexible bag to be secured over the ends thereof under tension so that the mouth of the bag is secured in place. Second horizontal members 24, 26 extend between the vertical members 16 and 18, and 20 and 22 respectively, to add strength and rigidity.

Base 34 is constructed of parallel end members 36, 38 and side members 40, 42. Each side member is formed of two parallel bars 44, 46 and 48, 50 respectively, forming elongated slots 52, 54. Each vertical member 16, 18, 20, 22 has a threaded end 56 which extends through slots 52, 54 in base 34. Each vertical member has welded to it above the threaded section a horizontal clamp member 58 which is shaped to bear on the upper surface of bars 44, 46, 48, 50. A second horizontal clamp element 60 slides freely on threaded end 56 and is shaped to bear against the lower surface of bars 44, 46, 48, 50, under pressure from nut 62 as nut 62 is tightened on threaded end 56.

Figure 5:
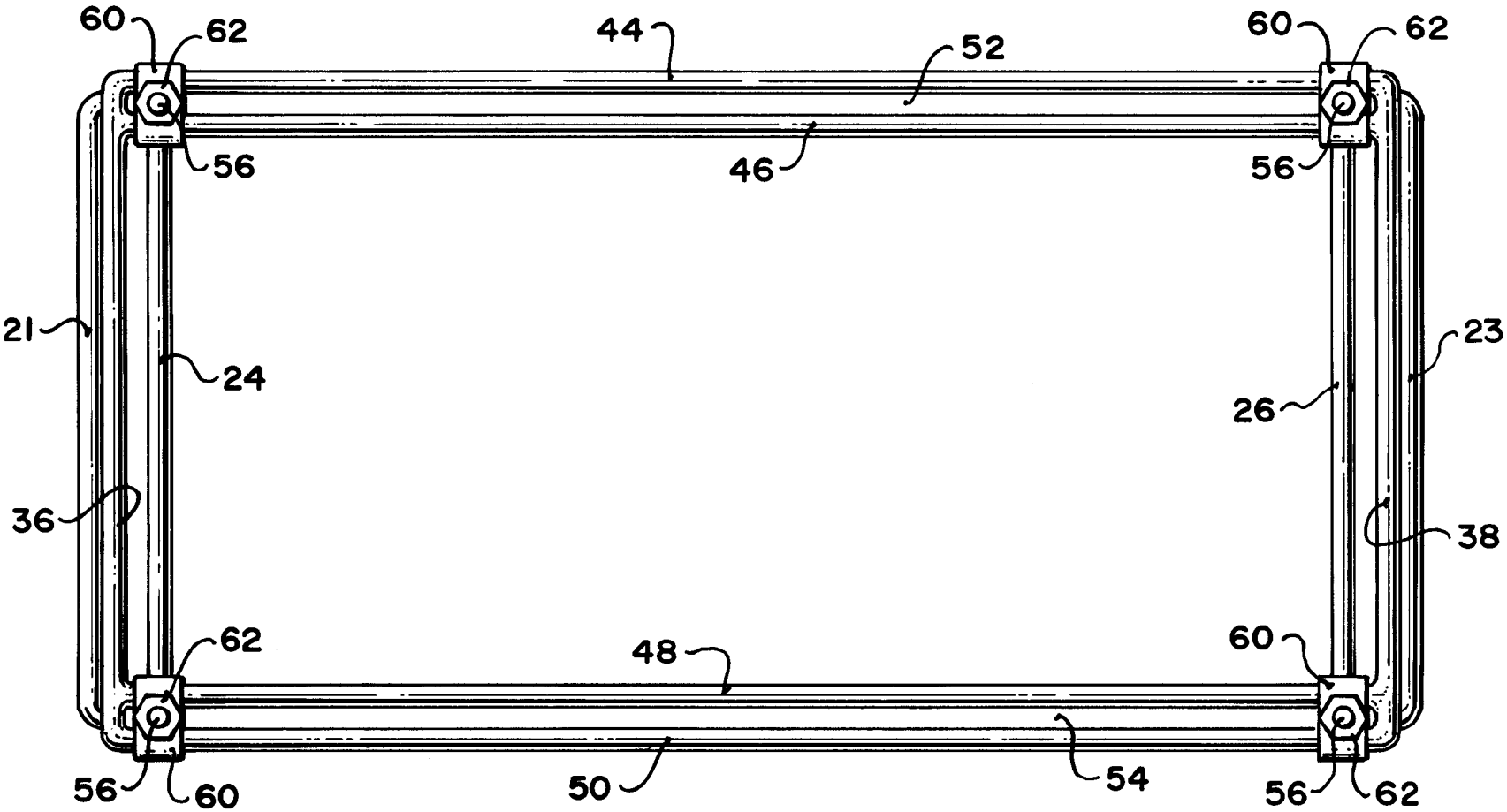
FIG. 5 is a bottom view of the invention shown in FIG. 1.
Figure 5A:
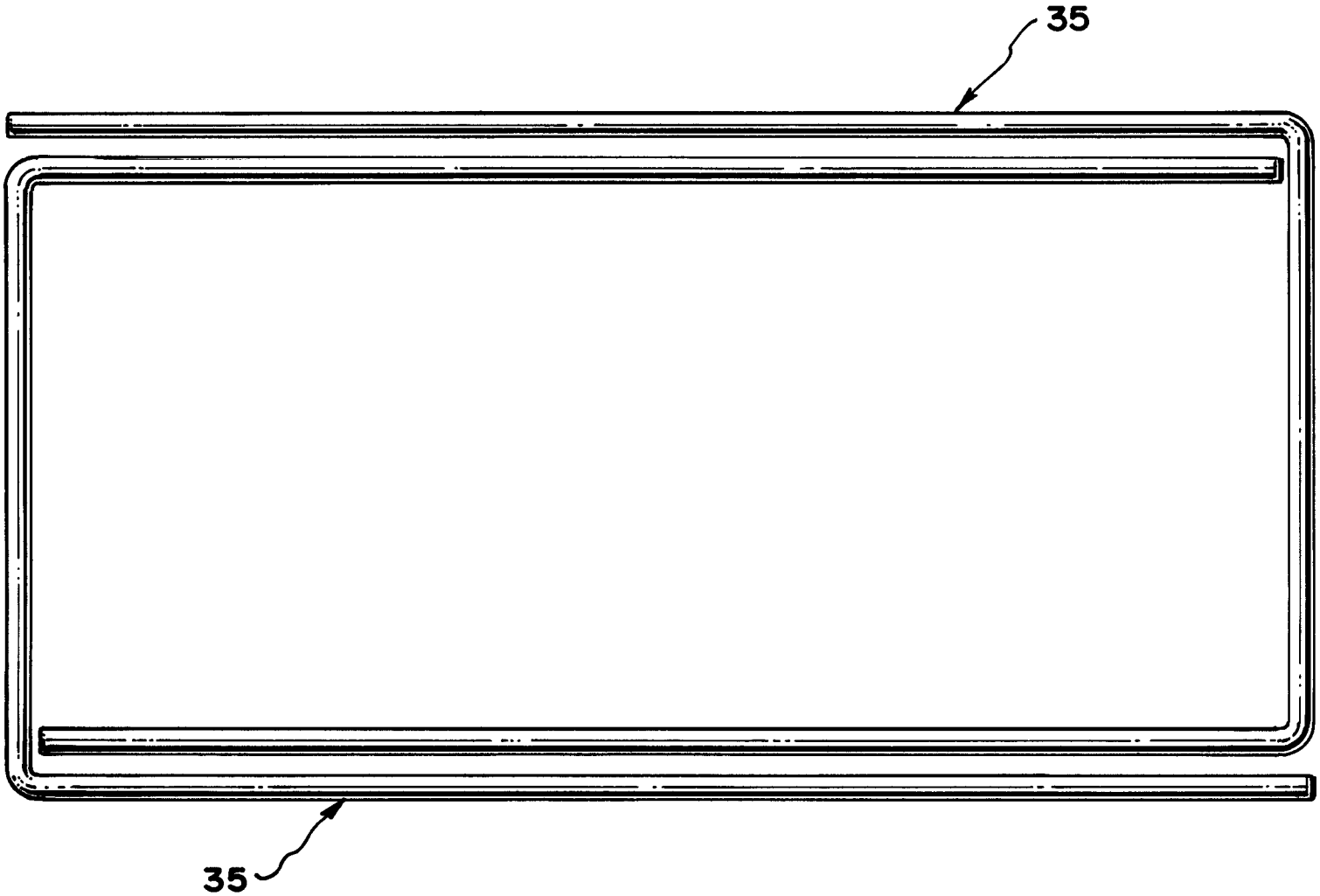
FIG. 5A is a top plan view illustrating a method of constructing the base of the invention shown in FIG. 1.
Figure 6:
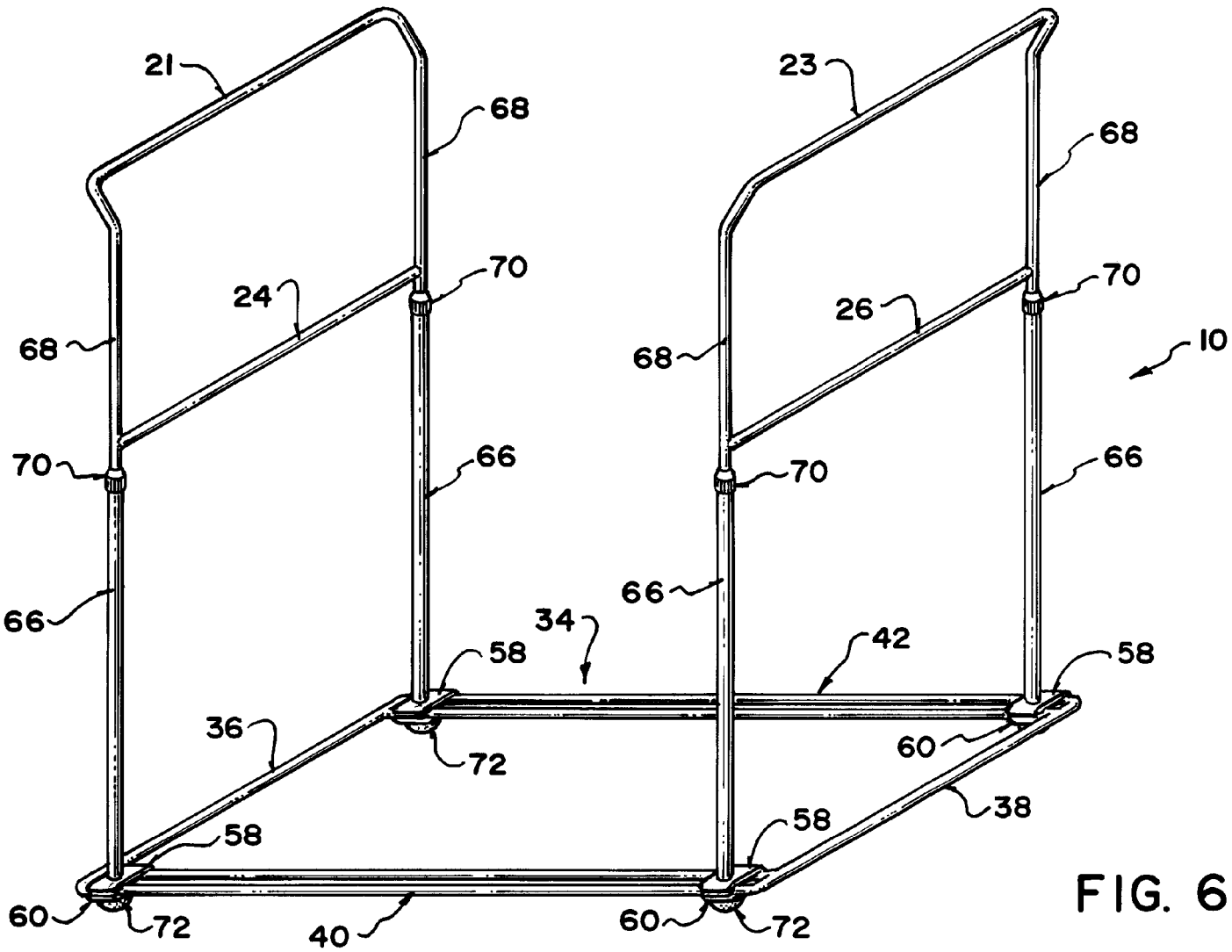
FIG. 6 is a perspective view of a second embodiment of the invention in which the lateral positions of the two vertical frames are adjustable to a continuum of positions along the base element and the vertical frame members are also adjustable in height.
Figure 7:
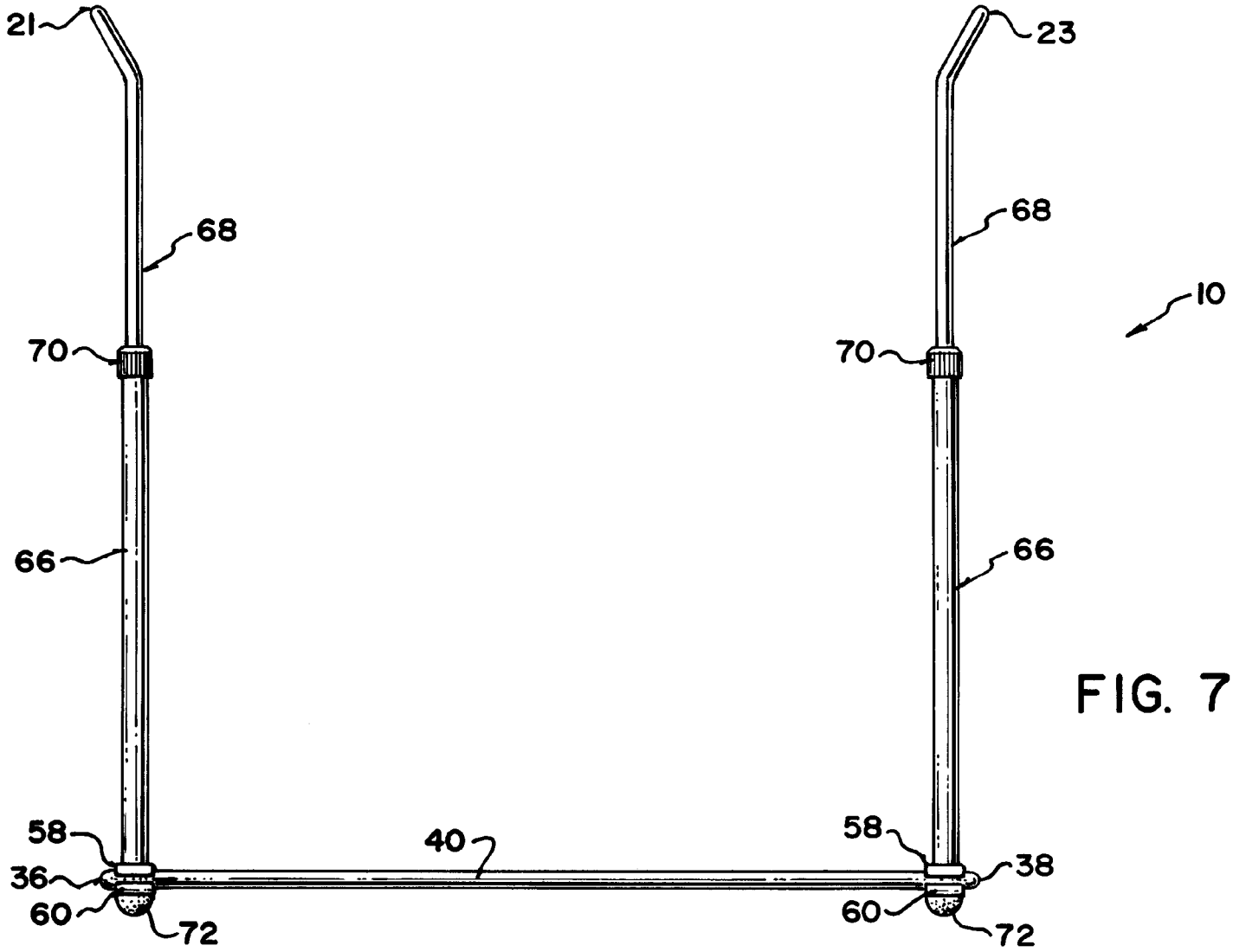
FIG. 7 is a front view of the embodiment of the invention shown in FIG. 6, the rear view being a mirror image thereof.
Figure 8:
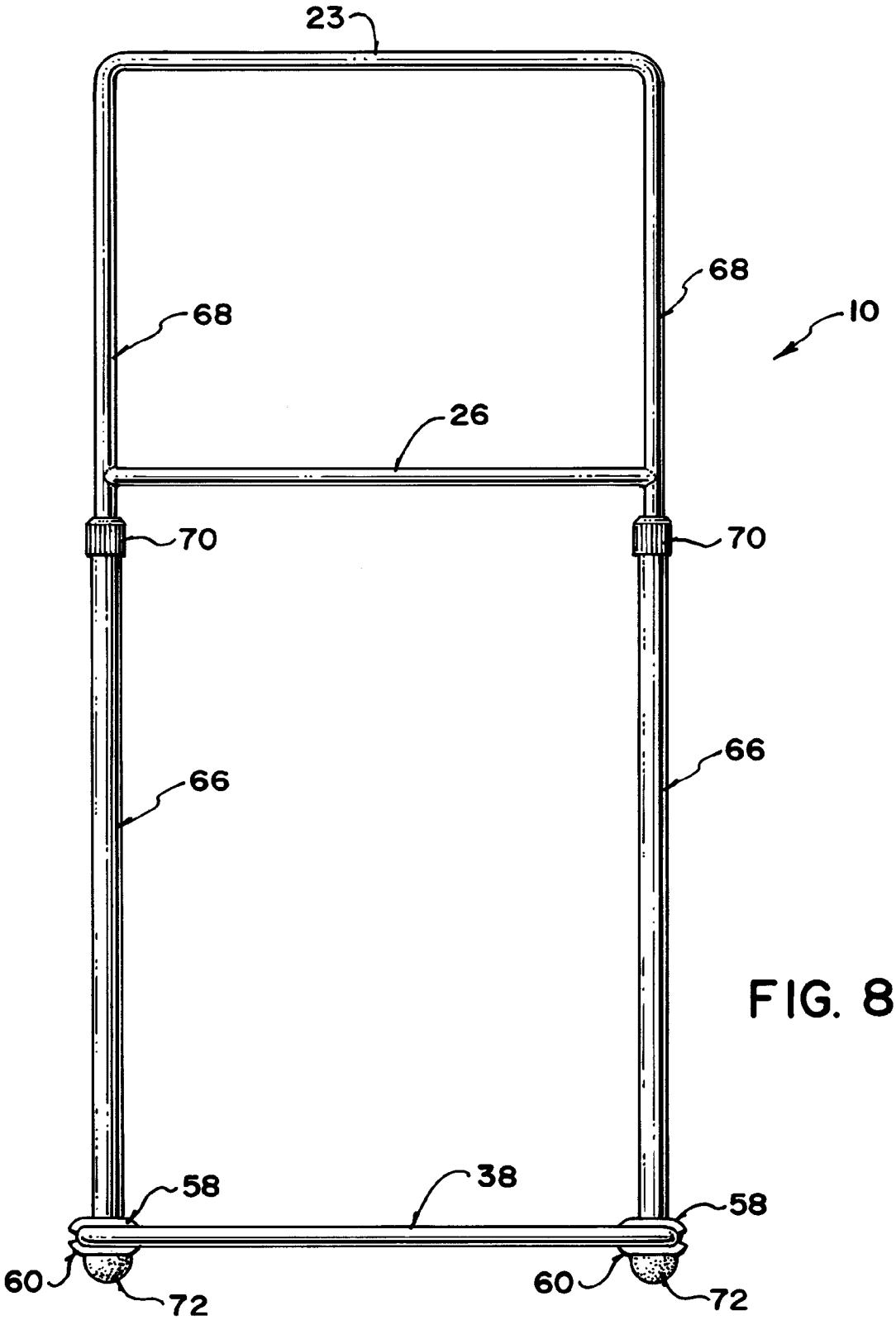
FIG. 8 is a right side view of the invention shown in FIG. 6, the left side view being a mirror image thereof.
Figure 9:
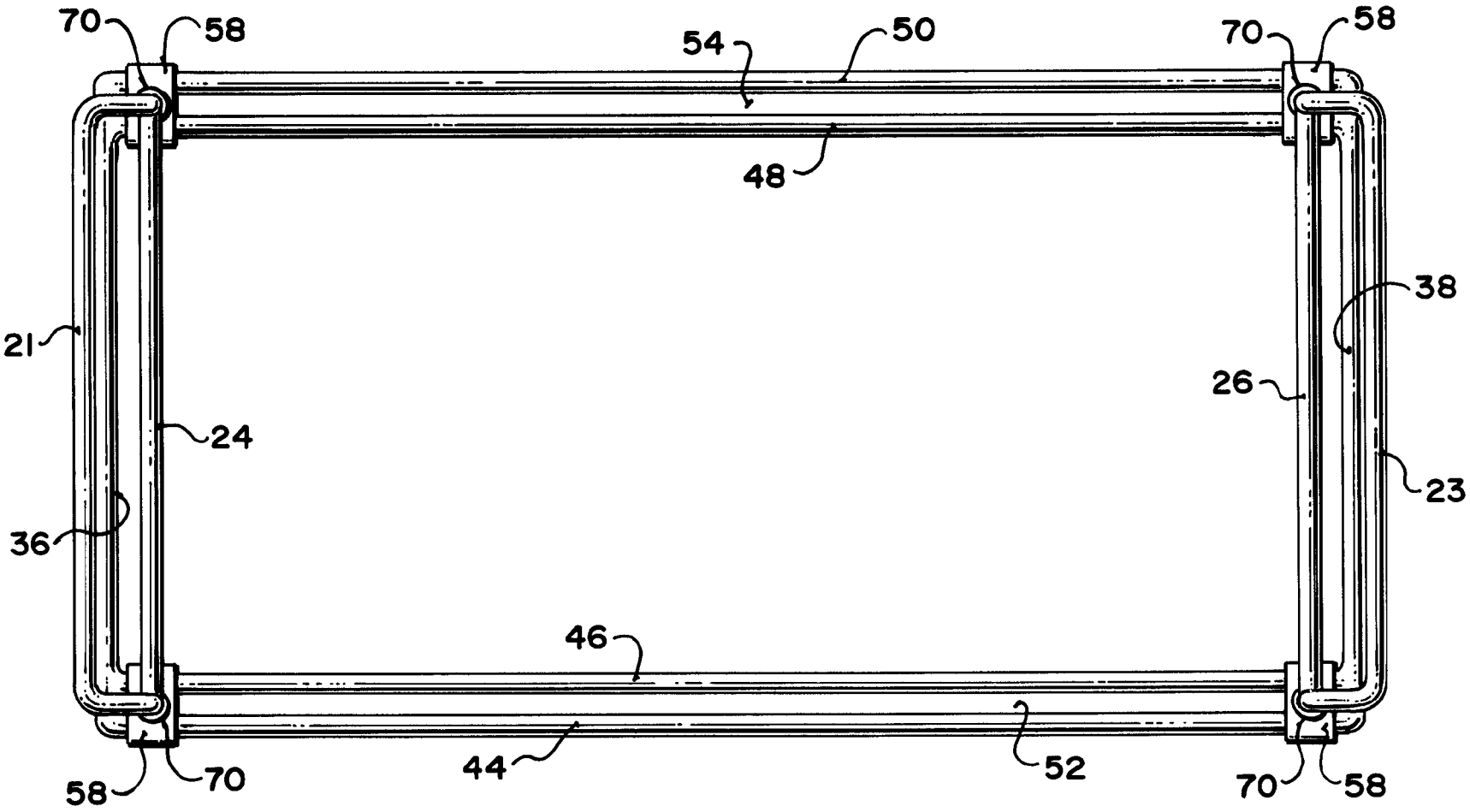
FIG. 9 is a top view of the invention shown in FIG. 6.
Figure 10:
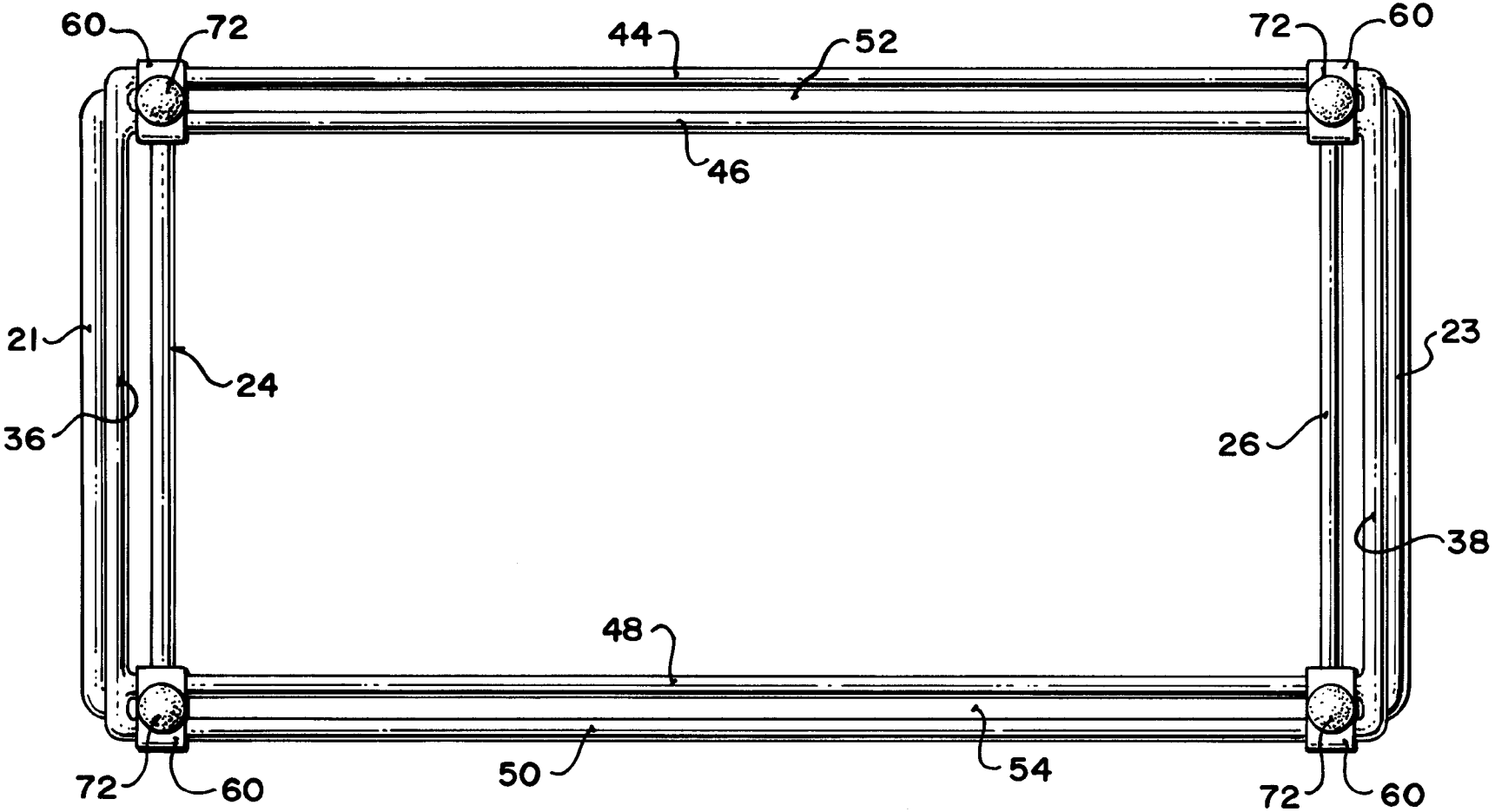
FIG. 10 is a bottom view of the invention shown in FIG. 6.
Figure 11:
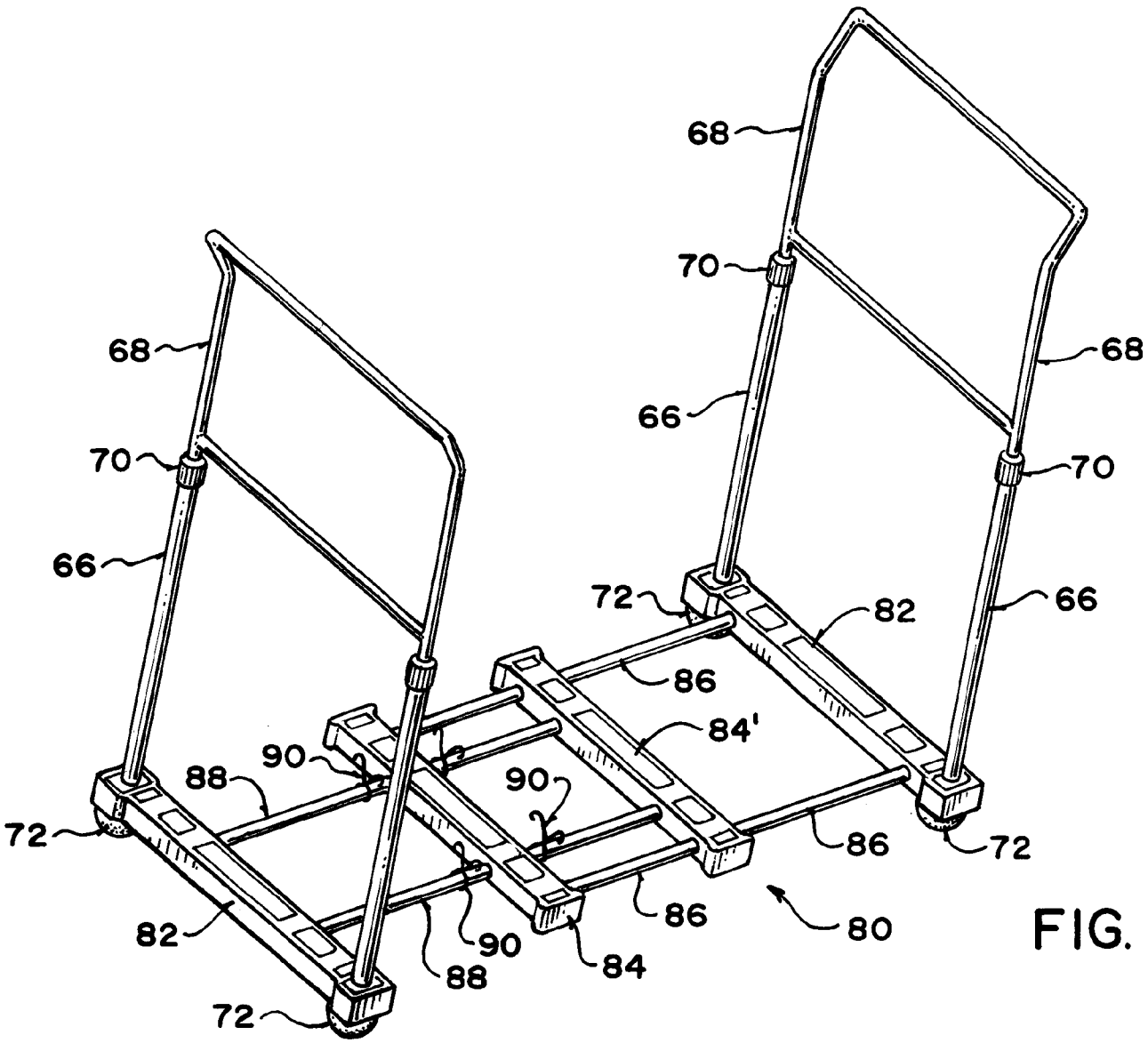
FIG. 11 is a perspective view of a third embodiment of the invention, in which the lateral positions of the two vertical frames are adjustable to a continuum of positions along the base element.
Figure 12:
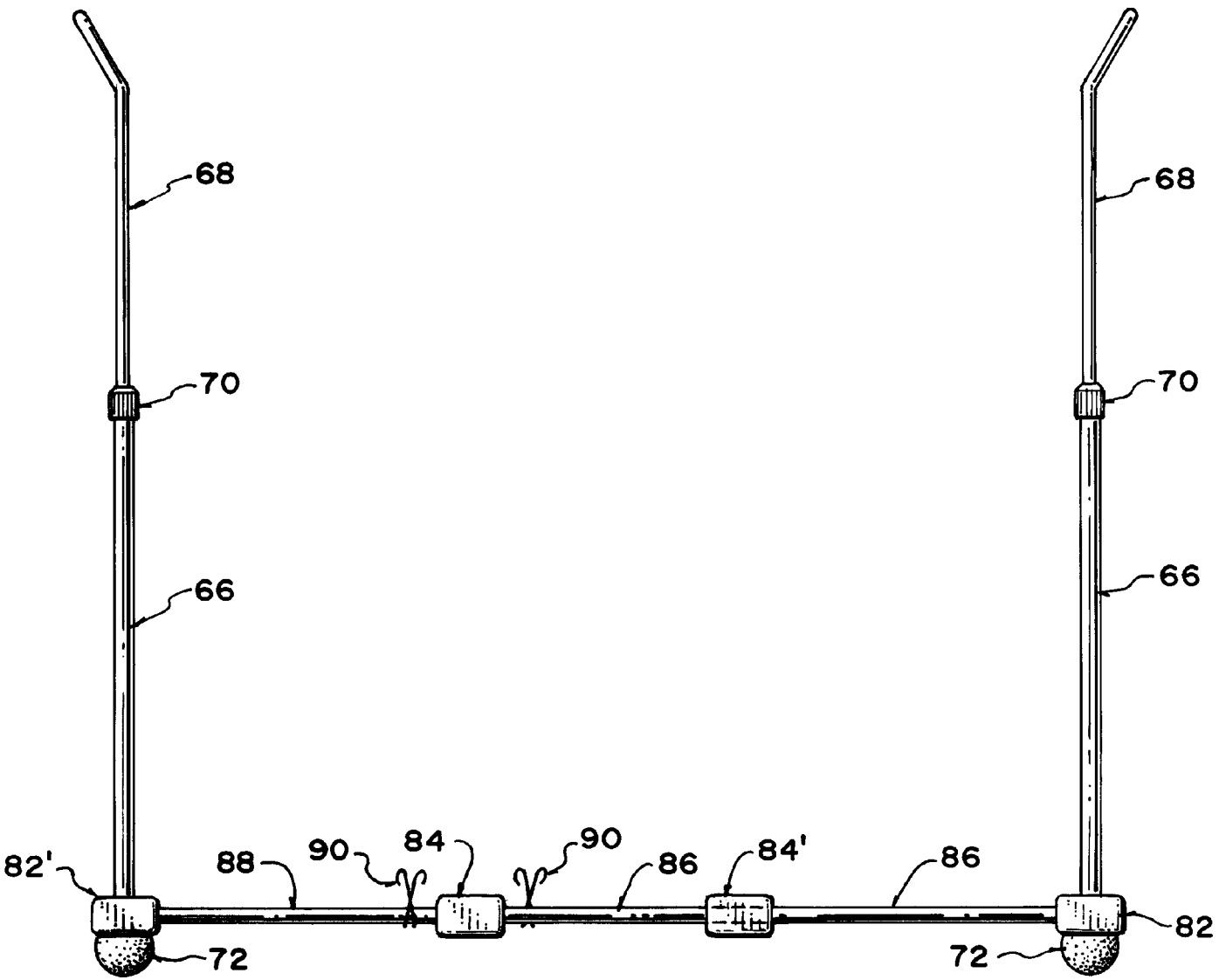
FIG. 12 is a front view of the embodiment of the invention shown in FIG. 11, the rear view being a mirror image thereof.
Figure 13:
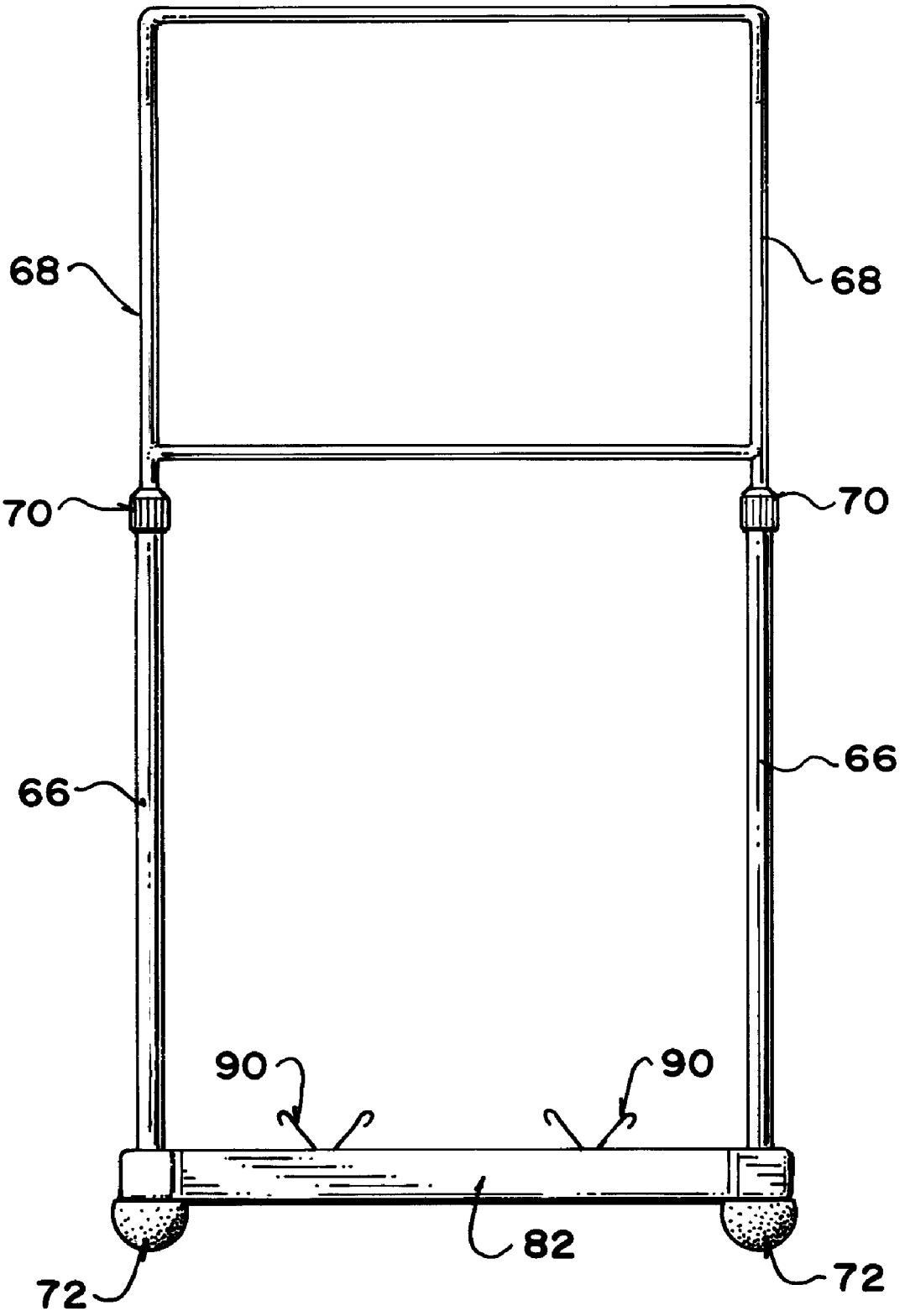
FIG. 13 is a right side view of the invention shown in FIG. 11, the left side view being a mirror image thereof.
Figure 14:
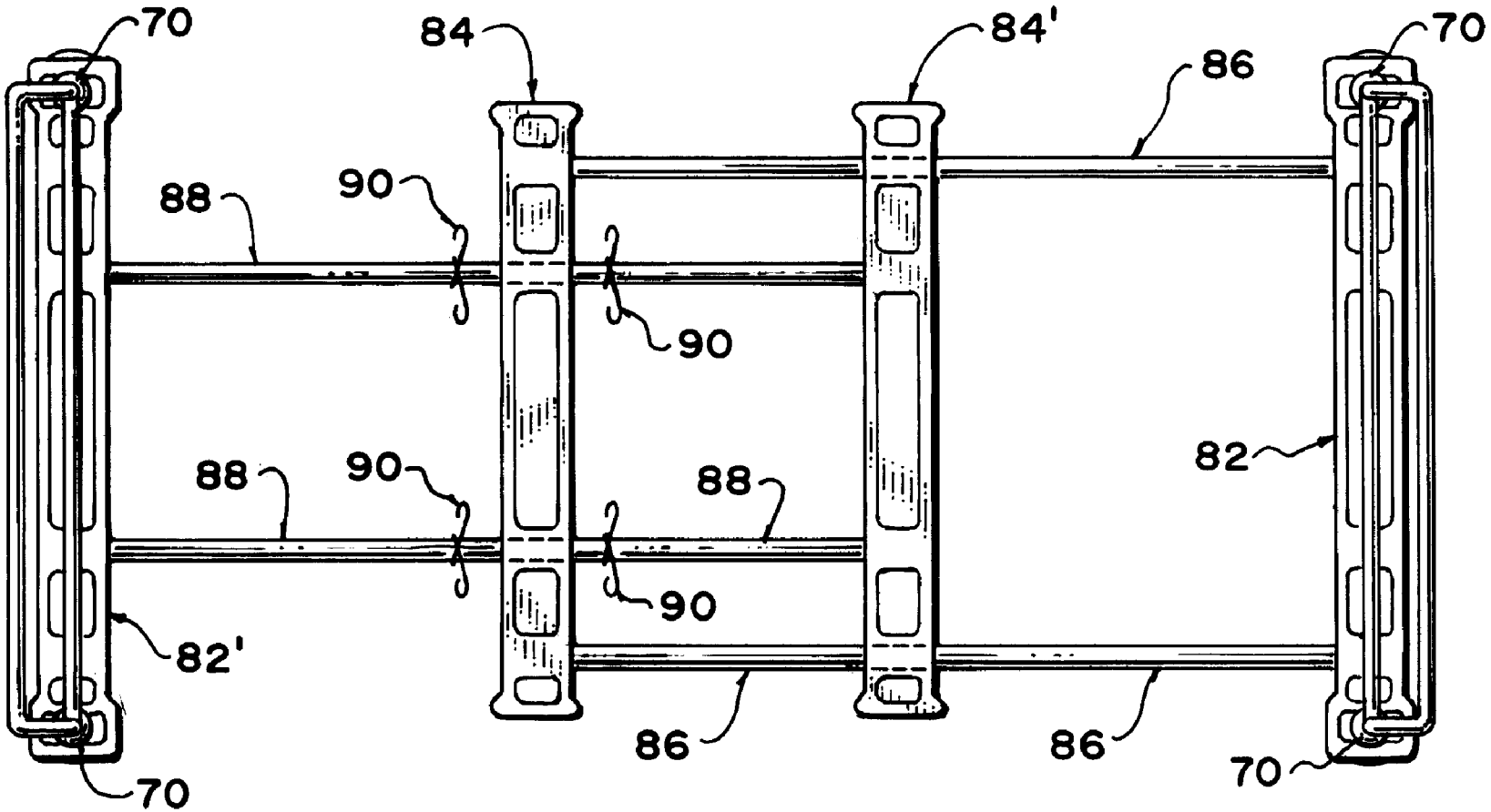
FIG. 14 is a top view of the invention shown in FIG. 11.
Figure 15:
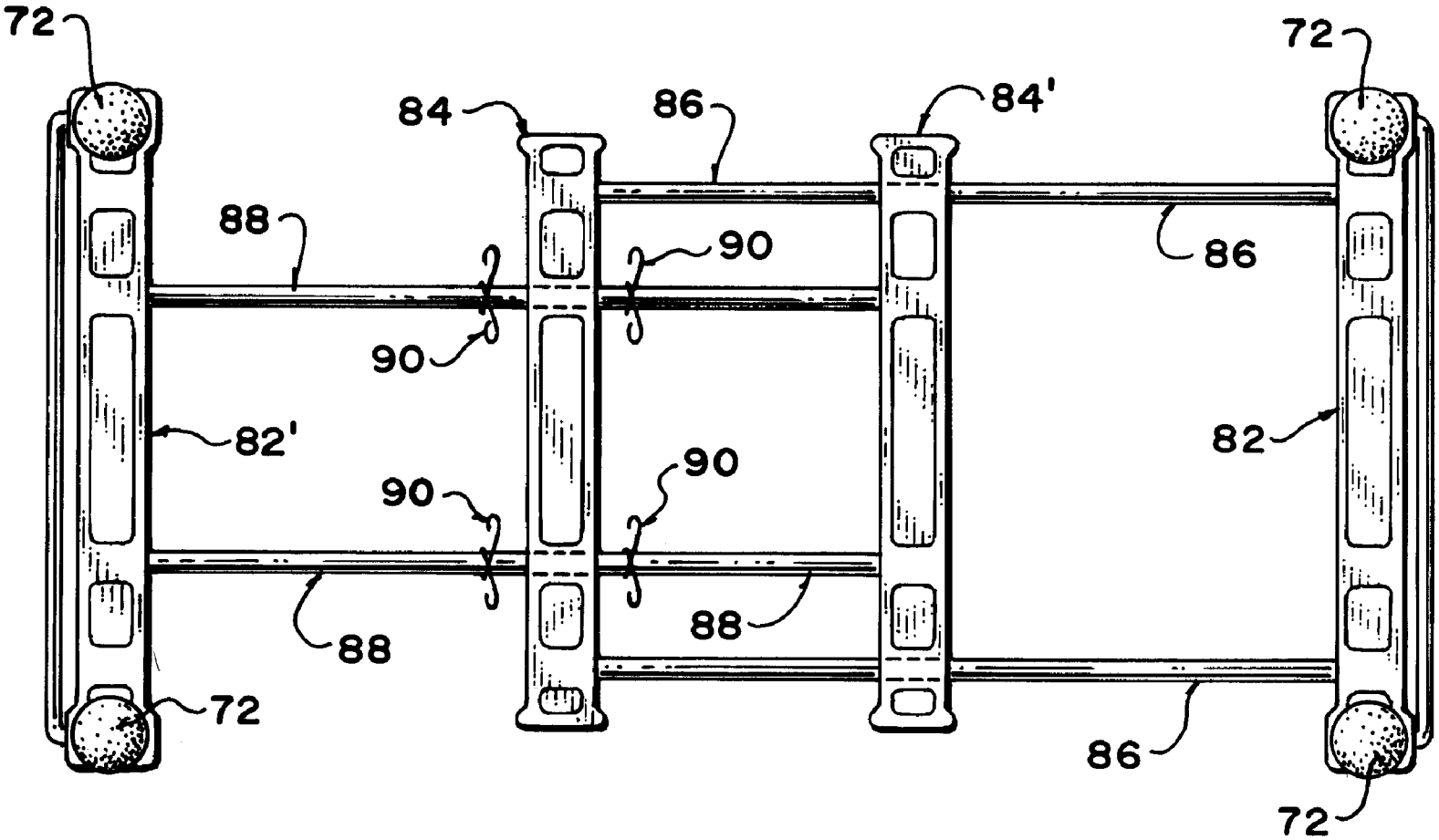
FIG. 15 is a bottom view of the invention shown in FIG. 11.

Base 34 can be constructed using a minimum of welds by bending two C-shaped tubular elements 35 which are then joined in a facing relationship by welds at the points of contact, as illustrated in FIG. 5A.

Thus the invention provides a support for flexible bags of various widths, such as plastic garbage bags, garden bags, plastic recycling bags and cloth laundry bags. The user moves the vertical elements to the desired width and secures them in place at that width. The bag is then placed between the vertical elements, open end up, and the open end of the bag is then stretched over the upper ends of the vertical elements, holding it in place, and can be removed from the side (unlike garbage cans).

In the embodiment shown in FIGS. 6 through 10, each vertical member consists of outer hollow tubular members 66 and inner vertical member 68. A tightening member 70 is provided on each vertical member which by rotation thereof alternately tightens or loosens the outer member 66 against the inner member 68 to permit the height of the vertical elements to be adjusted. In this embodiment the nuts 62 are provided with hemispherical rubber feet 72 to reduce marking on a floor surface. Wheels or casters may also be provided in place of feet 72.

In the embodiment shown in FIGS. 11 through 15, the vertical members are adjustable in height as in the second embodiment, however a different structure for adjusting the width of base 80 is provided. Base 80 consists of two parallel end elements 82, 82' and two parallel intermediate elements 84, 84'. Outer slide bars 86 are secured at either end thereof in elements 82, 84 and extend through holes in element 84' with a sliding friction fit. Similarly, inner slide bars 88 are secured at either end thereof in elements 82', 84' and extend through holes in element 84 with a sliding friction fit. Removable spring clips 90 can be positioned on slide bars 88 as shown to limit the extent of movement of the intermediate elements 84, 84', or to fix the base 80 at a particular width. To adjust the width of the base, therefore, end elements 82, 82' are separated to the desired degree, and spring clips are clipped to bars 88 on either side of element 84 to hold the base at that width, In this embodiment, therefore, the footprint of the stand decreases to conform to the width of the bag, and the vertical elements are more easily kept in parallel.

Figure 16:
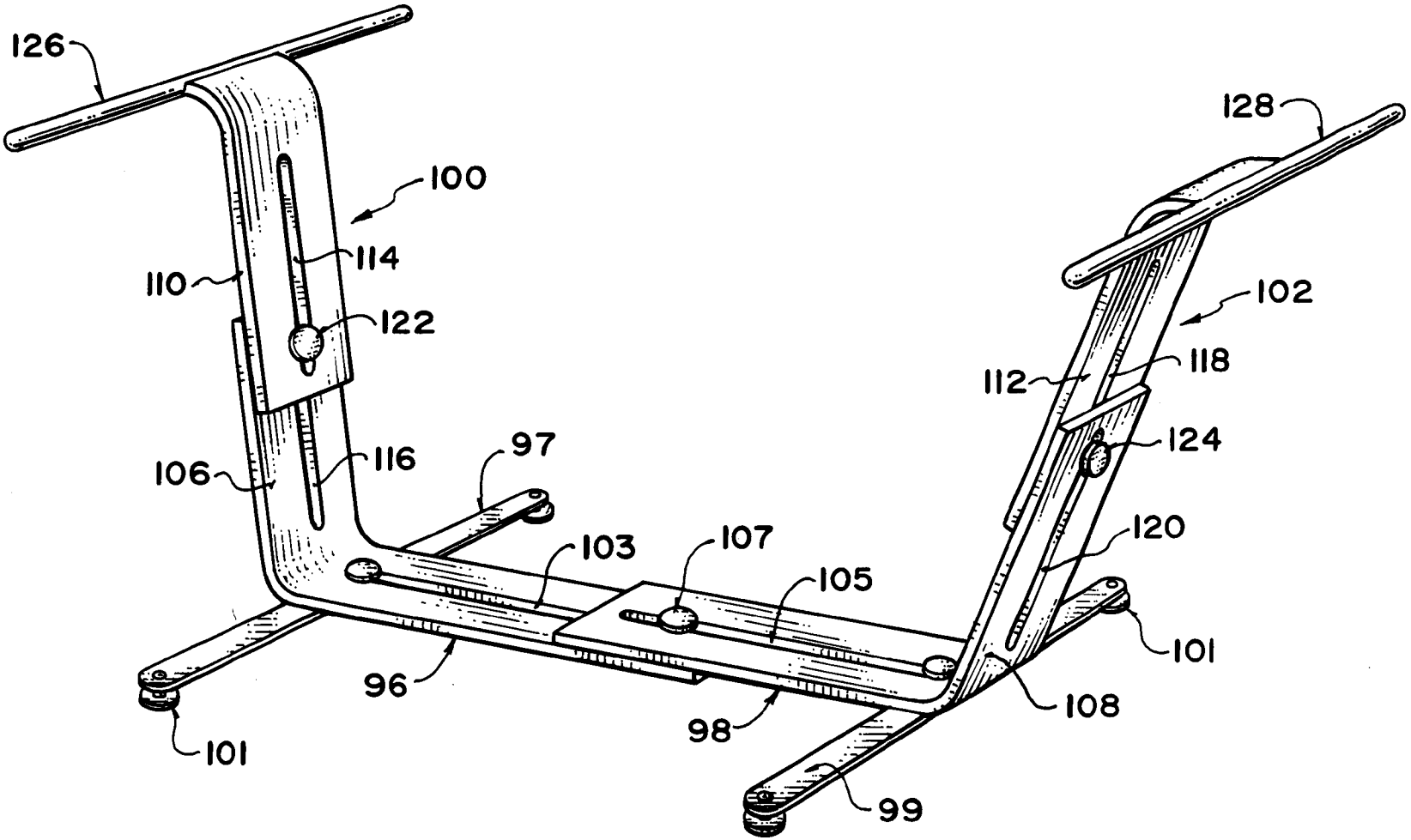
FIG. 16 is a perspective view of a fourth embodiment of the invention in which the lateral positions of the two vertical frames are adjustable to a continuum of positions along the base element and the vertical frame members are also adjustable in height.

In the embodiment shown in FIG. 16, the base member consists of two L-shaped members 96, 98 which have secured thereto perpendicular leg members 97, 99 with feet or casters 101. Base members 96, 98 each have a central slot 103, 105 and a threaded tightener nut 107 is provided to join slots 103, 105 and permit the separation of vertical elements 100, 102 to be adjusted and secured in place, in the same manner as the height of a stenographer chair can be adjusted. Similarly, vertical members 100, 102 are formed of the upper extensions 106, 108 of base members 96, 98 and members 110, 112, each provided with central slots 114, 116, 118, 120 and joined by tightener nuts 122, 124 so that the vertical members are individually adjustable in height as in the second embodiment, and may be fixed at different heights for holding a bag at an angle. Horizontal bars 126, 128 receive the open end of the bag.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An adjustable support for flexible bags having an open end, comprising:

i) first and second opposed, parallel vertical elements, each vertical element comprising means at the upper end thereof for receiving said open end of said bag;

ii) a base member adapted for stable placement on a planar surface connected to said vertical elements, whereby the space between said vertical elements is adjustable; and iii) means for releasably adjusting each said vertical element independently at a fixed height;

wherein each vertical element comprises parallel vertical members angled outwardly at the upper end thereof and joined by at least one horizontal member.

2. An adjustable support for flexible bags having an open end, comprising:

i) first and second opposed, parallel vertical elements, each vertical element comprising means at the upper end thereof for receiving said open end of said bag;

ii) a base member adapted for stable placement on a planar surface connected to said vertical elements, said vertical elements being slidably engaged with said base member, whereby the space between said vertical elements is adjustable; and iii) means for releasably securing said vertical elements at a fixed spacing;

wherein said base member comprises parallel end members and side members, each side member formed of two parallel bars forming elongated slots for receiving said vertical members.

3. An adjustable support according to claim 2 wherein each said vertical member comprises a threaded end which extends through said slots in said base member.

4. An adjustable support according to claim 3 wherein each said vertical member further comprises, secured to it above said threaded section, a first horizontal clamp member which is shaped to bear on the upper surface of said base member, a second horizontal clamp member adapted to slide freely on said threaded end and shaped to bear against the lower surface of said base member, and means for tightening said second horizontal clamp member against said base member.

5. An adjustable support according to claim 2 wherein said base member is constructed of opposed C-shaped members secured in facing, interleaved relationship thereby forming said slots between respective arms of said C-shaped members.

6. An adjustable support for flexible bags having an open end, comprising:

i) first and second opposed, parallel vertical elements, each vertical element comprising means at the upper end thereof for receiving said open end of said bag, wherein each vertical element comprises parallel vertical members angled outwardly at the upper end thereof and joined by at least one horizontal member;

ii) a base member adapted for stable placement on a planar surface connected to said vertical elements, whereby the space between said vertical elements is adjustable, said base member comprising two parallel end members, two parallel intermediate members parallel to said end members, and four parallel horizontal members having first and second ends and being perpendicular to said parallel end members and parallel intermediate members, each parallel end member having secured thereto the lower end of one of said vertical elements and the first ends of two of said horizontal members, and each of said parallel intermediate members having secured thereto the second ends of two of said horizontal elements and being slidably engaged by the remaining two horizontal members; and iii) means for releasably, independently adjusting the height of each said vertical element.

7. An adjustable support according to claim 6 wherein said parallel intermediate members are slidably engaged by two horizontal members by being provided with holes sized to permit said horizontal members to slide therethrough.

8. An adjustable support according to claim 7 wherein each vertical element comprises inner and outer telescoping members, and means for releasably securing said inner and outer members in a fixed relationship.

9. An adjustable support according to claim 8 wherein said means for releasably securing said inner and outer members in said fixed relationship comprises a rotatable threaded tightener mounted on an upper end of an outer telescopic member of said inner and outer telescopic members.

* * * * *